United States Patent [19]

Sellars, Jr.

[11] Patent Number: 4,972,907

[45] Date of Patent: Nov. 27, 1990

[54] METHOD OF CONDUCTING WELL OPERATIONS FROM A MOVEABLE FLOATING PLATFORM

[75] Inventor: Claude A. Sellars, Jr., Houston, Tex.

[73] Assignee: Shell Offshore Inc., Houston, Tex.

[21] Appl. No.: 85,299

[22] Filed: Aug. 10, 1987

Related U.S. Application Data

[63] Continuation of Ser. No. 790,711, Oct. 24, 1985, abandoned.

[51] Int. Cl.[5] ..... E21B 43/01; E21B 7/128

[52] U.S. Cl. ..... 166/353; 166/354; 166/355; 166/367; 175/7

[58] Field of Search ..... 166/352–355, 166/366, 365, 358, 359, 338, 335, 367; 175/5, 7, 8; 405/201, 224

[56] References Cited

U.S. PATENT DOCUMENTS

| | | | |
|---|---|---|---|
| 3,209,827 | 10/1965 | Lacy et al. | 166/354 |
| 3,327,780 | 6/1967 | Knapp et al. | 166/352 |
| 3,363,683 | 1/1968 | Corley, Jr. et al. | 166/355 |
| 3,376,922 | 4/1968 | Leonhardt, Jr. | 166/358 |
| 3,602,302 | 8/1971 | Kluth | 166/352 |
| 3,988,898 | 11/1976 | McDonald | 166/358 |
| 4,240,506 | 12/1980 | Dareing | 166/367 |
| 4,301,760 | 11/1981 | Cassone et al. | 166/354 |
| 4,375,835 | 3/1983 | Archer | 166/353 |
| 4,519,728 | 5/1985 | Oshima et al. | 405/224 |
| 4,735,267 | 4/1988 | Stevens | 166/345 |

FOREIGN PATENT DOCUMENTS

| | | | |
|---|---|---|---|
| 2097358 | 11/1982 | United Kingdom | 166/355 |

*Primary Examiner*—Hoang C. Dang

[57] ABSTRACT

A method is described for conducting well operations from a floating platform that may be moved to various locations above subterranean formations. Marine risers that have been previously connected to the platform flex sufficiently to allow this movement. The mobility of the platform allows well drilling, completion, producing, and workover activities to be conducted simultaneously through the risers attached to the platform. The mobility of the platform also allows new wells to be drilled at more preferable locations than those that would be available from a fixed bottom supported well template.

13 Claims, 4 Drawing Sheets

METHOD OF CONDUCTING WELL OPERATIONS FROM A MOVEABLE FLOATING PLATFORM

This is a continuation of application Ser. No. 790,711, filed Oct. 24, 1985, now abandoned.

BACKGROUND OF THE INVENTION

1. Field of the Invention

The present invention relates to a method of conducting well operations from a moveable floating platform floating on a body of water.

2. Description of the Prior Art

As the exploration for oil and gas reserves has extended into deeper offshore waters new technology has been developed that makes possible the drilling and production of offshore wells. Bottom-supported platforms have been typically used to drill and produce these wells in water depths now reaching up to 1500 feet. Due to the high cost of these bottom-supported structures, however, floating platforms are typically used in deeper water. As can be imagined, however, the large capital expenditures associated with the fabrication and installation of any type of platform in these deep water depths dictates that any discovered field of petroleum reserves be economically developed as soon as possible.

In the typical development of an offshore field of petroleum reservoir(s) all of the wells are drilled, thereafter all of the wells are subsequently completed and production is then started from the field. But this sequence of operations may result in one or more years delay before any oil and/or gas production from the field is sold. Only after production is sold can any amount of return on the investment required for the offshore platform be realized.

As can be imagined, methods have been studied that accelerate the positive cash flow from a field in order to offset the carrying costs of the initial capital outlay required for the fabrication and installation costs of the platform (and drilling costs). To quickly retire the debt associated with the large capital expenditure, wells may be placed on production while new wells are being drilled. In this method a first well is drilled, completed and placed on production almost simultaneously with the start of the drilling of the second well. In this manner early oil and/or gas production from the field may be used to quickly pay off the initial fabrication, installation and drilling costs. This "drilling while producing" operation has been typically practiced from bottom-supported and tension leg platforms.

A problem exists, however, in drilling a plurality of wells from a bottom-supported structure or a tension leg platform structure because the location of each well upon the bottom of the body of water is fixed by the location of well conductors in the case of the bottom-supported platform or by the location of the template used to anchor the tension leg platform. But as each new well is drilled, and it's geological structure studied by use of "logging" and/or other tools the ideal bottom location of each additional well can be readily determined. For example, after a few wells are drilled it may be found that the next series of wells should be drilled approximately 300 feet from the existing position of the platform. But, due to the immobility of the template beneath the floating platform or the conductors of the bottom-supported platform the wells drilled from bottom-supported or tension leg platforms may only be initiated in a set location not favorable to more economic field development.

A method need be developed therefore that allows the location of additional wells to be adjustable on the bottom of the body of water as the field development progresses. This method should allow the most favorable placement of the drainage pattern while development of the field progresses.

SUMMARY OF THE INVENTION

In a preferred embodiment of the present invention, the mobility of a floating platform is advantageously used to methodically locate in an efficient manner the position of each new well upon the bottom of a body of water. Previously drilled wells may remain connected to the floating platform by means of flexible risers as the platform is moved to a new well location. In this manner since the risers remain attached to the floating platform, simultaneous production while drilling operations may be commenced.

In a preferred embodiment of the method of the present invention a floating platform is initially positioned above the reservoirs to be subsequently developed by drilling and production. At least one well is initially drilled into these reservoirs while the floating platform remains at its original location. The well may be drilled by use of a drilling riser which extends from the floating platform down through the body of water to the location on the bottom of the body of water where it is desired to locate the well. After the well is drilled and completed a production riser may be substituted for the drilling riser to allow the fluids in the reservoir to be produced to the floating platform and subsequently sold. While the initial well is being readied for production the floating platform may be moved to another location nearby and another well subsequently drilled from the floating platform. The mobility of the floating platform allows subsequent wells to be located at their optimum locations for efficient field development, and allows production during drilling operations. The optimum location of each additional well may be determined after study of the location indicated by well "logging" techniques well known to the art of the reservoir(s) penetrated by each prior well.

It should be recognized, of course, that any well operation may be conducted below the floating platform, the operation, for example, being the drilling, completion, production, or workover of a well or the enhanced recovery flooding of an injection well. Once this well operation is in progress, the platform may be subsequently moved to another location and another well operation commenced at that new location. In this manner different well operations may be simultaneously conducted from a floating platform on different wells.

By use of the method of the present invention of conducting well operations from a moveable floating platform all reservoir fluids may be more efficiently produced. If early production is desired, each well may be drilled and thereafter placed on production to the platform. When all wells have been placed on production the floating platform may be moved above well locations requiring specific well maintenance operations to be performed. These maintenance operations or "workover" operations may be conducted simultaneously with the continued production of reservoir fluids.

Since the initial bottom location of the wells is now not confined within a small template or well conductor area, each well can now be located in a position that minimizes the drilling and production costs associated with that well. The use of expensive directional drilling techniques may be minimized by application of this method since each well may now be positioned upon the bottom of the water closer to the reservoir that the well is attempting to drill into.

It is therefore a feature of the invention to allow accelerated return on the investment required for the installation, fabrication and start-up of a floating platform. It is a further feature of the method of the invention to allow the efficient location of each new well.

It is a further feature of the method of the invention to move a floating platform from an initial well operations position to another well operations position. It is a further feature of the method of the invention to conduct simultaneous well operations from a moveable floating platform.

These and other features, objects and advantages of the present invention will become apparent from the following detailed description wherein references are made to the figures and the accompanying drawings.

DESCRIPTION OF THE PREFERRED EMBODIMENT

Figure 1:
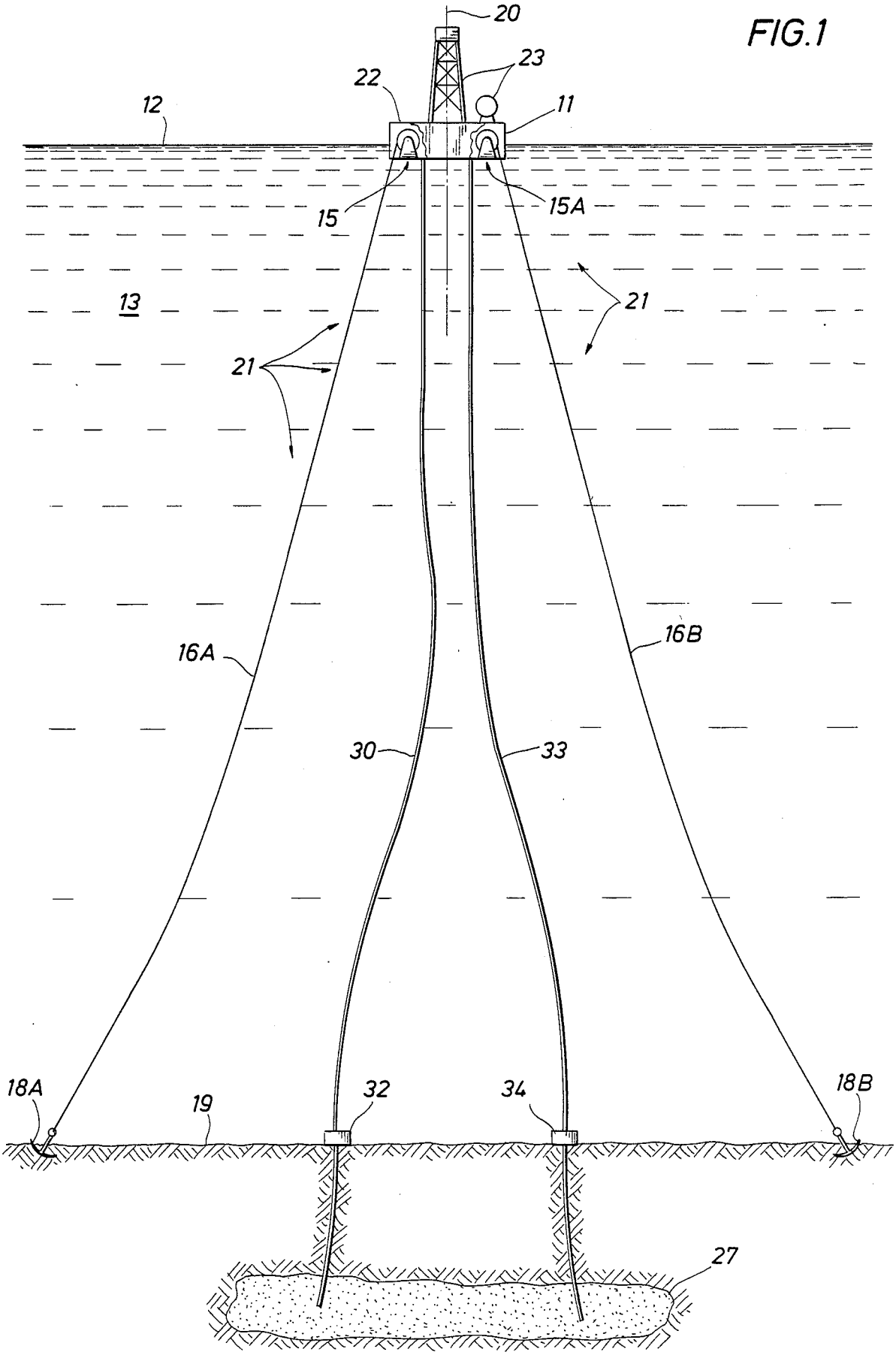
FIG. 1 is a schematic representation showing a moveable floating platform anchored to the bottom of a body of water.
Figure 2:
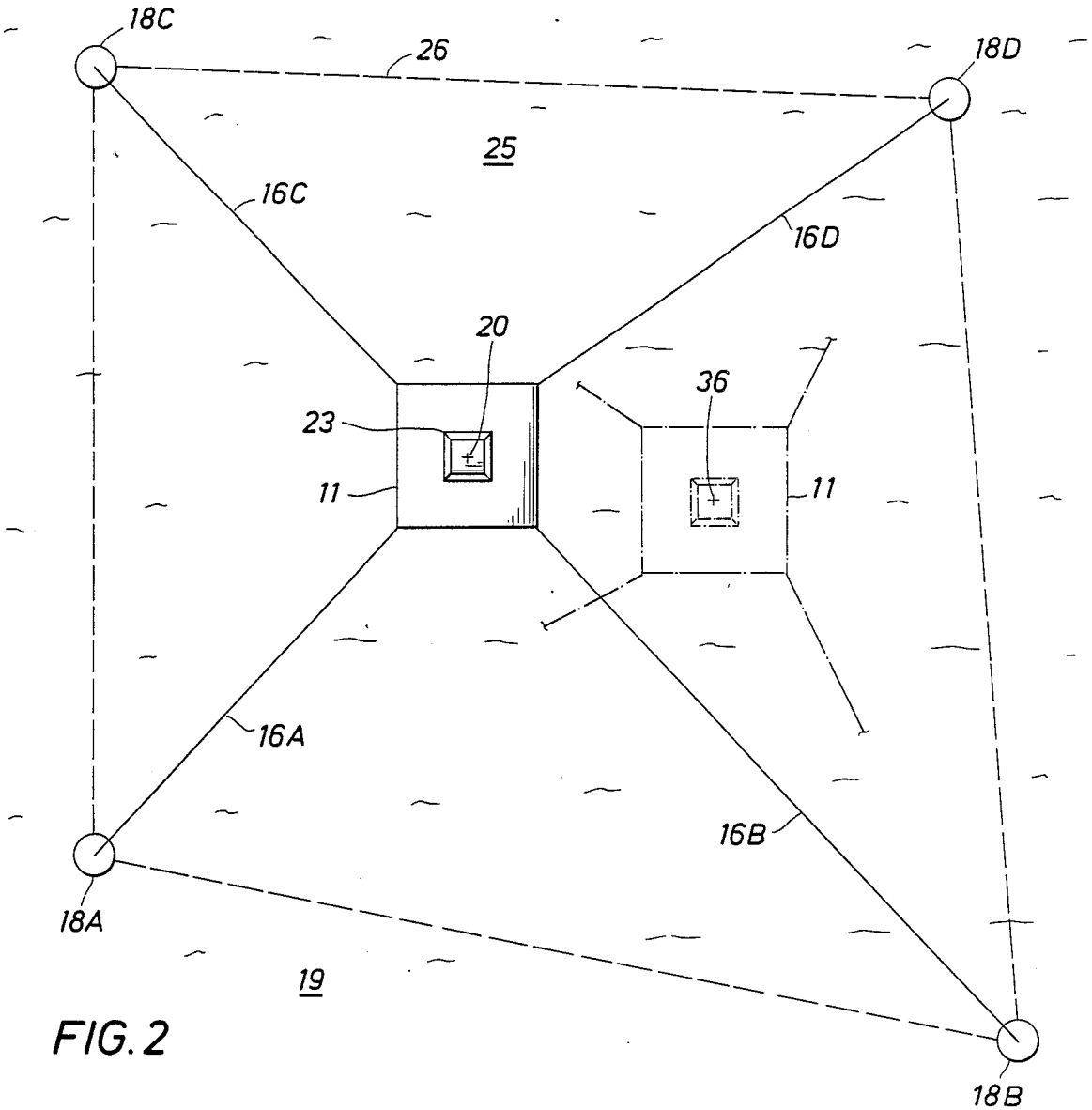
FIG. 2 is a schematic representation showing the floating platform in plan view located above and secured by anchors to the bottom of said body of water.
Figure 4:
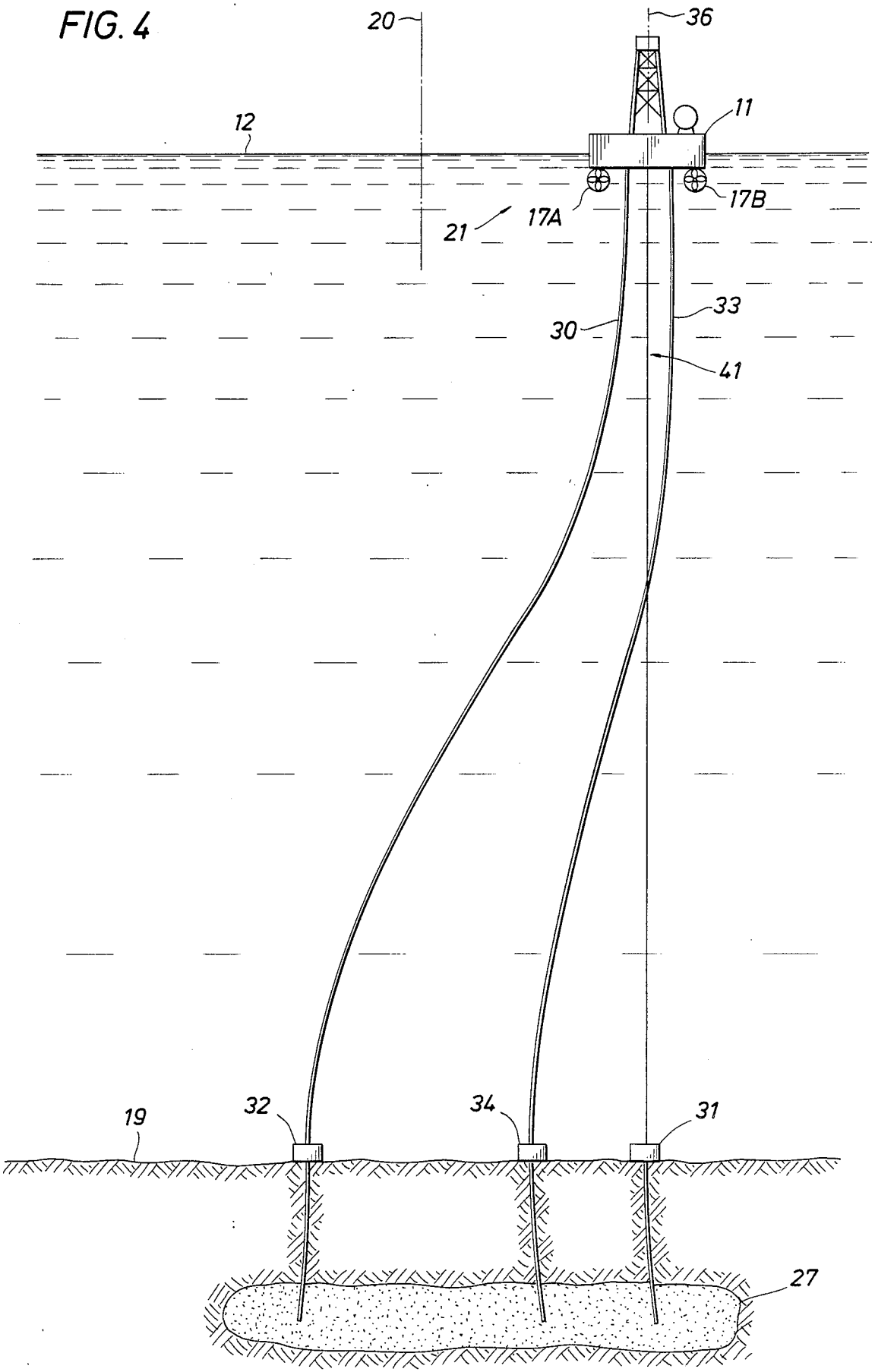
FIG. 4 is a schematic representation showing the floating platform positioned by means of thrusters.

Referring now to FIGS. 1 and 2 a moveable floating platform 11 is shown floating upon the surface 12 of the body of water 13. Anchor cable length adjustment means 15, such as winches well known to the art are shown carried by the platform 11. The length adjustment means 15, 15A are operable to regulate the tension and length of anchor cables 16A, 16B, 16C, 16D which are shown depending downward from the length adjustment means 15, 15A through said body of water 13 to discrete anchors 18A, 18B, 18C, 18D, respectively, arranged in an array at the bottom 19 of the body of water 13. The platform 11 thereby is operatively connected to the anchors 18A, 18B, 18C, 18D by the anchor cables 16A, 16B, 16C, 16D and is shown anchored in a first vertical position 20. Length adjustment means 15, 15A anchor cables 16A, 16B, 16C 16D and anchors 18A, 18B, 18C, 18D form a portion of the positioning means 21 that is used to position the platform 11 over a particular location. It is well recognized, of course, that many other types of means 21 well known to the art may be used to properly position the platform 11 such as by use of thrusters 17A, 17B as shown in FIG. 4, shown operatively engaged to a directionally positioned floating platform 11.

Deck 22 is shown holding well operations equipment 23. It is well understood that this equipment may take may forms. If it is desired to conduct well drilling operations at a particular location the well operations equipment 23 will typically consist of a derrick, kelly bushing, rotary table, unassembled drill pipe sections, well conductor(s), casing, mud equipment, blow out preventers, and drilling riser sections and other equipment 23 well known to the art required to conduct the drilling operations at the deck 22 location, as well as, at the submerged location of the well. If it is desired to conduct production operations at a particular location, the well operations equipment 23 will typically include facilities well known to the art such as test separators, high and low pressure gas and/or oil separation equipment, vent systems, compressors, etc. well known to the art located on the platform 11, as well as, production riser sections, production casing, and wellhead equipment required to complete the drilled well and place the well in fluid communication with the platform 11 production equipment required to produce a well or a series of wells. In other words, the well operations equipment includes all assembled or disassembled equipment 23 necessary to drill, complete, produce, workover, or inject fluids into a well or a particular series of wells, or perform any other well operation by the use of well operation equipment well known to the art.

In a preferred embodiment the first vertical position 20 is defined by a substantially vertical relationship between the floating platform 11 and an area 25 which is defined within the perimeter 26 formed by anchors 18A, B, C, and D. The anchors 18A–D are shown forming an array about the bottom of the body of water 19. It is well recognized that many different patterns of anchors 18A–D may be used to suitably position floating platform 11 above the desired subterranean formation 27 located beneath the bottom 19 of the body of water 13. Area 25 is typically located above subterranean formation 27 that contains a possible source of hydrocarbon production.

An upper end of at least one marine riser 30 is shown operatively engaged to the floating platform 11. This marine riser 30 may take the form of a drilling or production riser well known to the art and may generally have a fluid opening (not shown) defined centrally downward through the riser 30 for the passage of drilling and/or production fluids (not shown). It is understood that the marine riser 30 may also take the form required to allow well workover operations or injection operations to be performed on subsea wells. In the method of the present invention at least one marine riser 30 is engaged to the floating platform 11 prior to conducting well operations at a new underwater well location 31 (shown in FIG. 3). The marine riser 30 extends downwardly from the floating platform 11 through the body of water 13, the lower end of the marine riser 30 being operatively engaged to well equipment 32 shown disposed upon the bottom 19 of the body of water 13. As mentioned earlier, the well equipment 32 will typically consist of assembled portions of the well operations equipment 23 previously carried on the platform 11. The marine riser 30 also will have been assembled from a portion of the well operations equipment 23, and will typically be flexible enough due to its extended length to allow the platform 11 to move upon the surface 12 to various positions such as the first and second vertical positions 20, 36.

The well equipment 32 may take the form of a subsea production well-head (not shown) such as that provided by Vetco Offshore Inc., 2550 North Loop West, Suite 850, Houston, Tex. 77092 if it is desired to install a subsea well-head at the bottom 19 of the body of water 13. Alternatively, it is well recognized that the production well-head may be mounted upon the floating platform 11. If the marine riser 30 consists of a drilling riser a portion of the well-head equipment 32 may take the form of blow-out prevention equipment well known to the art such as that provided by Vetco Offshore Inc.

Another marine riser 33 is also shown operatively engaged at its upper end to the moveable floating platform 11. The lower end of marine riser 33 is shown operatively engaged at its lower end to other well equipment 34 which as mentioned before may take several forms.

Figure 3:
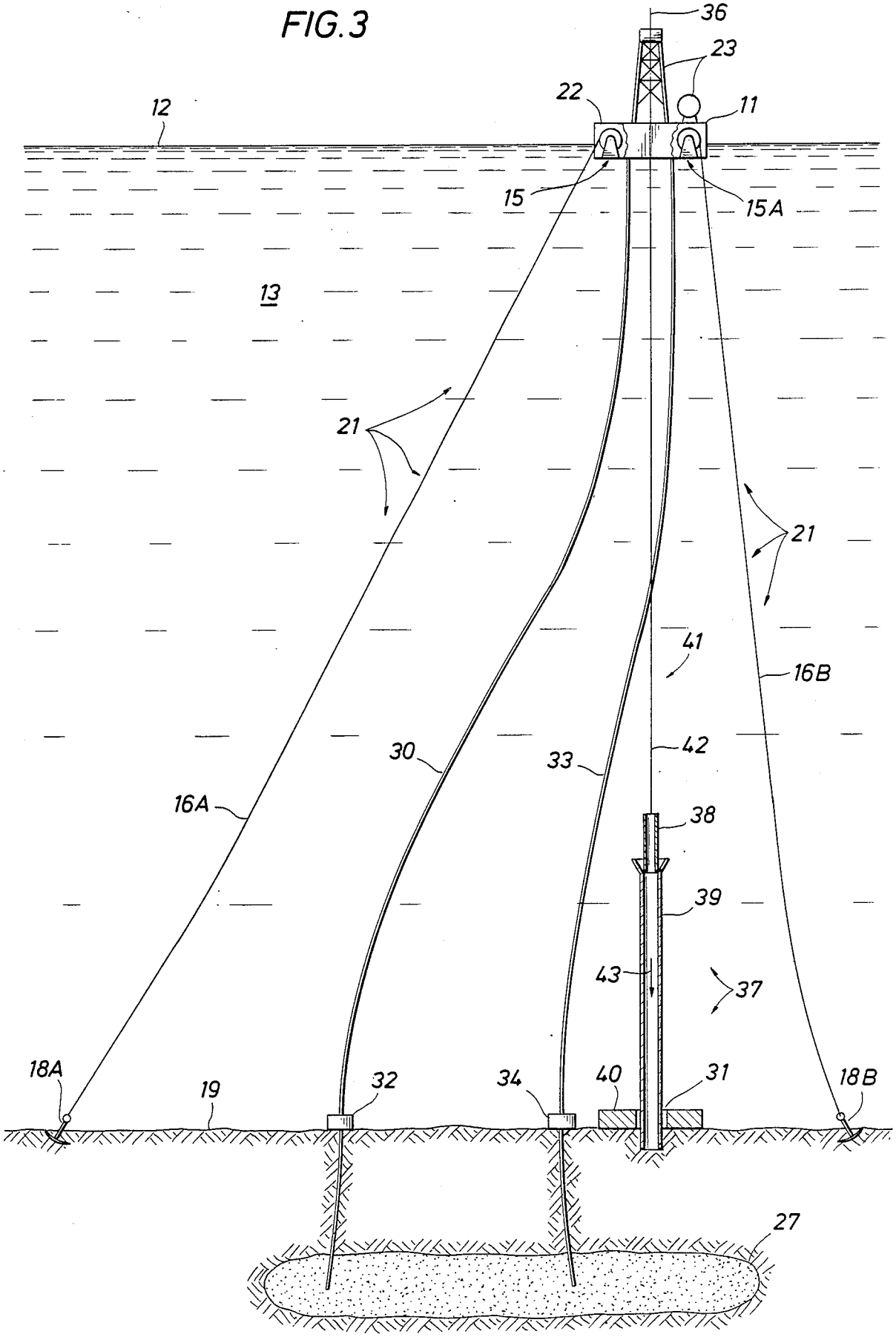
FIG. 3 is a schematic representation showing the floating platform positioned vertically above the location on the bottom of the body of water where the underwater well operations will be conducted.

Referring now to FIGS. 1, 2 and 3 the method of conducting well operations at a underwater well location 31 can be seen to include the following steps. First, the moveable floating platform 11 with the upper end of at least one marine riser 30 operatively engaged to the platform 11, is laterally displaced from the first vertical position 20 to a second vertical position 36 which is defined by a substantially vertical relationship between the platform 11 and the location of or for the underwater well 31 upon the bottom 19 of the body of water 13. The lower end of the riser 30 is operatively engaged to well equipment 32. The platform 11 may be moved to a position 36 vertically above the desired origination location of the underwater well 31, if it is desired to drill a new well at that particular location 31. It is recognized, of course, if an operation other than drilling will be conducted at location 31, that well equipment 32 will probably already be present at location 31. The second vertical position 36 may therefore be alternatively defined vertically above an existing well location 31 that has previously been drilled, or any other location on the bottom 19 of the body of water 13.

If positioning means 21 taking the form of an anchoring system are used to move the platform 11 from the first vertical position 20 to the second vertical position 36, the first vertical position 20 may be defined substantially vertically above the area 25 defined within the perimeter 26 formed by the anchors 18A–D as shown in FIG. 2. In other words, if anchors 18A–D are used as positioning means 21 in all probability the platform 11 will not be located outside of the perimeter 26 defined by the anchors 18A–D, though it is well recognized that in certain situations it may be desirable to relocate the floating platform 11 temporarily outside of the array of anchors 18A–D, for example by using surface vessels (not shown) to push the platform 11 outside the anchor 18A–D array. In this manner the platform 11 may be used to service a well or drill a new well in a location away from the normal anchored location of the platform 11.

It is well recognized, of course, that if thrusters 17A, 17B (FIG. 4) are used as positioning means 21 to move the platform 11 the first vertical position 20 need only be defined by a substantially vertical relationship between the platform 11 and at least the suspected location of subterranean formation 27, or any other location on the bottom 19 of the body of water 13.

The platform 11 may also be moved from a first vertical position 20 to a second vertical position 36 by relocation of at least one of the anchors 18A–D from the anchors' 18A–D original location upon the bottom of the body of water 19. The anchors 18A–D may be relocated by means well known to the art, such as by use of another surface vessel (not shown) used to pick up and move the anchor(s) 18A–D to a new location.

Second, well operations equipment means 37 in a preferred embodiment used for the drilling of a well at location 31 and consisting of drill collar 38, well conductor 39 and temporary guide base 40 may be contacted to the bottom 19 of the body of water 13, at the underwater well location 31. The well operations equipment means 37 are operatively engaged to the lower end of conduit means 41 such as in a preferred embodiment consisting of drill pipe 42, the conduit means 41 depending downwardly from the floating platform 11, the upper end of the conduit means 41 being operatively engaged to the floating platform 11.

Prior to the step of contacting the well operations equipment means to the bottom 19 of the body of water 13 the well operations equipment means 37 may be assembled from portions of the well operations equipment 23 located on the floating platform 11 by methods well known to art. The equipment means 37 may then be attached to the lower end of the conduit means 41 and then lowered vertically downward through the body of water 13 for example by the addition of sections of drill pipe 42. It is well recognized that conduit means 41 comprising sections of drill pipe 42 may be extended downwardly through the body of water 13 by the addition of additional sections of drill pipe 42.

In a preferred embodiment when it is desired to conduct the drilling of a well at the underwater well location 31 it can be seen that the well operations equipment means 37 includes a well conductor 39 carried by the lower end of the conduit means 41. Extension and lowering down of the conduit means 41 from the platform 11 in a vertically downward direction thereby eventually causes the contact of the well conductor 39 in a vertical fashion with the bottom 19. Once the well conductor 39 has contacted the bottom 19 in a vertical manner, a source of pressurized fluid 43 such as water may be supplied from the floating platform 11 through the conduit means 41 by means well known to the art in order to jet the well conductor 39 into the bottom 19, by methods well known to the art.

It is well recognized that many other types of well operations equipment means 37 may have been connected to the lower end of the conduit means 41 in order to perform various well completion, workover, injection, drilling, and/or producing operations, beneath the surface 12 of the body of water 13.

Figure 5:
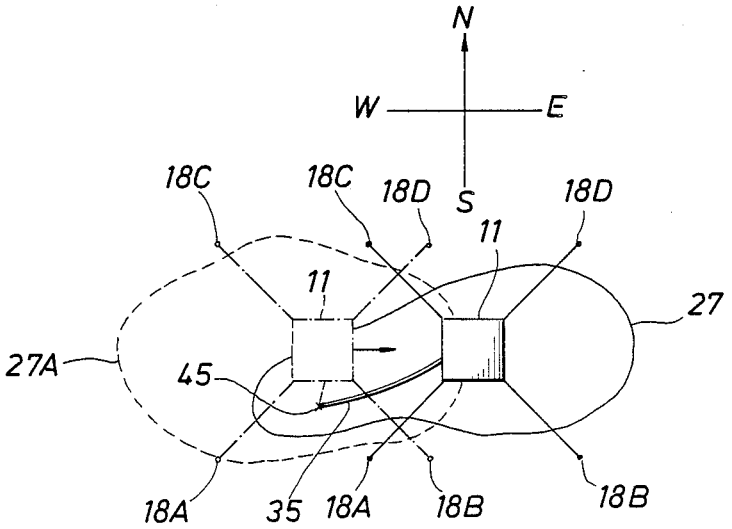
FIG. 5 is a schematic representation showing the relocation of the platform to a more favorable position above an underground formation.

Referring now to FIG. 5, the advantages inherent with the use of the method of the present invention will become more apparent. In a typical example of field development, the platform 11 had originally been positioned above the initial expected central location for the formation 27A. A well 45 had been drilled and logged at that location. Study of the well 45 logs indicated that the majority of the preferred formation 27 was located to the east of well 45. A production riser 35 was connected between the bottom location of well 45 and the platform 11, and the platform 11 subsequently moved to a more central location over formation 27. Well 45 may now be produced as further wells (not shown) are drilled and completed into formation 27 generally beneath the new location of platform 11.

Notice that the further development of formation 27 is not hampered by the requirement of drilling each new well through a stationary template (not shown), that if used in this example would have caused each new well to be initiated at the bottom location of well 45, if the template was originally used at that location.

Notice also that the platform 11 was moved to a new location by relocation of all of the anchors 18A–D.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

What is claimed is:

1. A method of simultaneously conducting well operations at a first underwater well and a second underwater well from a moveable platform floating upon the surface of a body of water, said platform having;

well operations equipment thereon, and anchor cable length adjustment means carried by said platform and being operable to regulate the length and tension of anchor cables operatively engaged to said anchor cable length adjustment means, said anchor cables depending downward from said anchor cable length adjustment means through said body of water to discrete anchors arranged in an array at the bottom of said body of water, said platform thereby operatively connected to said anchors by said anchor cables and anchored in a first vertical position, said first vertical position defined by a substantially vertical relationship between said platform and an area defined within the perimeter formed by the anchors of said anchor array, said method of simultaneously conducting well operations at said first underwater well and said second underwater well including the steps of;

operatively engaging a marine riser between said floating platform and well equipment disposed upon the bottom of said body of water positioned at said first underwater well located substantially beneath said floating platform, laterally displacing and bending a portion of said marine riser by moving said floating platform from said first vertical position to a second vertical position defined by a substantially vertical relationship between said platform and said second underwater well by adjusting the length of said anchor cables, and lowering well operations equipment means into contact with the bottom of said body of water at said second underwater well, said well operations equipment means operatively engaged to the lower end of conduit means that depend downwardly from said floating platform, the upper end of said conduit means operatively engaged to the lower end of conduit means that depend downwardly from said floating platform, the upper end of said conduit means operatively engaged to said floating platform.

2. The method of claim 1 including, prior to the step of lowering well operations equipment means into contact with the bottom of said body of water, the steps of;

assembling the well operations equipment means on said floating platform from said well operations equipment;

attaching said well operations equipment means to the lower end of said conduit means;

lowering said well operations equipment means vertically downward through said body of water by extending said conduit means downward through said body of water.

3. The method of claim 1 wherein the step of laterally displacing said floating platform to a second vertical position further includes the step of;

defining said second vertical position substantially vertically above said area defined within the perimeter formed by the anchors of said anchor array.

4. The method of claim 1 wherein the step of lowering well operations equipment means into contact with the bottom of said body of water further includes the step of;

carrying a well conductor which forms a portion of the well operations equipment means at the lower end of said conduit means, moving the lower end of said well conductor in a vertically-downward direction from a position adjacent the bottom of the body of water towards said bottom, thereby contacting said well conductor in a vertical manner with said bottom.

5. A method of simultaneously conducting well operations at a first underwater well and a second underwater well from a platform floating upon the surface of a body of water, said platform having;

well operations equipment thereon, and platform positioning means capable of maintaining said platform in a first vertical position and a second vertical position, said positioning means operatively engaged to said platform, said method of simultaneously conducting said well operations at said first underwater well and said second underwater well including the steps of;

operatively engaging a marine riser between said floating platform positioned at said first vertical position and well equipment disposed upon the bottom of said body of water positioned at said first underwater well located substantially beneath said floating platform, laterally displacing and bending a portion of said marine riser by moving said floating platform from said first vertical position to said second vertical position defined by a substantially vertical relationship between said platform and said underwater well by activation of said platform positioning means, and lowering well operations equipment means into contact with the bottom of said body of water at said second underwater well, said well operations equipment means operatively engaged to the lower end of conduit means that depend downwardly from said floating platform, the upper end of said conduit means operatively engaged to said floating platform.

6. The method of claim 5 including, prior to the step of lowering well operations equipment means into contact with the bottom of said body of water, the steps of;

assembling from said well operations equipment the well operations equipment means on said floating platform, attaching said well operations equipment means to the lower end of said conduit means, lowering said well operations equipment means vertically downward through said body of water by extending said conduit means downward through said body of water.

7. The method of claim 5 wherein the step of lowering well operations equipment means into contact with the bottom of said body of water further includes the step of;

carrying a well conductor which forms a portion of the well operations equipment means at the lower end of said conduit means, moving the lower end of said well conductor in a vertically-downward direction from a position adjacent the bottom of the body of water towards said bottom, thereby contacting said well conductor in a vertical manner with said bottom.

8. A method or simultaneously conducting well operations at a first underwater well and a second underwater well from a moveable platform floating upon the surface of a body of water, said platform having;

well operations equipment thereon, and platform positioning means capable of maintaining said platform in a first vertical position and subsequently moving said platform from said first vertical position to a second vertical position and maintaining said platform in said second vertical position, said first vertical position defined by a substantially vertical relationship between said platform and a location on the bottom of said body of water, said positioning means operatively engaged to said platform, said method of simultaneously conducting said well operations at said first underwater well and said second underwater well including the steps of;

operatively engaging a marine riser between said floating platform and well equipment disposed upon the bottom of said body of water positioned at said first underwater well located substantially beneath said floating platform, laterally displacing and bending a portion of said marine riser by moving said floating platform from said first vertical position to said second vertical position defined by a substantially vertical relationship between said platform and said location for said second underwater well upon said bottom of said body of water by activation of said platform positioning means, and lowering well operations equipment means into contact with the bottom of said body of water at said location for said second underwater well, said well operations equipment means operatively engaged to the lower end of conduit means that depend downwardly from said floating platform, the upper end of said conduit means operatively engaged to said floating platform.

9. A method of simultaneously conducting well operations at a first underwater well and at a second underwater well from a platform floating upon the surface of a body of water, said method including the steps of;

providing a vertically-oriented marine riser operatively engaged between said platform, and said first underwater well disposed vertically below said platform upon the bottom of said body of water, moving said platform from said vertical position above said first underwater well, thereby laterally displacing and bending a portion of said marine riser, positioning said platform vertically above said second underwater well, lowering well operations equipment means from said floating platform downward into contact with said second underwater well, and placing said first underwater well and said second underwater well in fluid communication with said platform.

10. A method of simultaneously conducting well operations at a first well and at a second well from a platform floating upon the surface of a body of water, said method including the steps of;

positioning said floating platform above said first well, operatively engaging a first marine riser between said floating platform and said first well thereby initiating well operations at said first well, moving said platform away from above said first well, movement of said platform laterally displacing and bending a portion of said first marine riser, and initiating well operations at said second well by use of well operations equipment means lowered downwardly from said floating platform into contact with the bottom of said body of water.

11. A method of simultaneously conducting well operations at a first well and at a second well from a platform floating upon the surface of a body of water, said method including the steps of;

positioning said floating platform above said first well, operatively engaging a first marine riser between said floating platform and said first well thereby initiating well operations at said first well, moving said platform away from above said first well, movement of said platform laterally displacing and bending a portion of said first marine riser, and operatively engaging a second marine riser between said floating platform and said second well thereby initiating well operations at said second well.

12. A method of simultaneously conducting well operations at a first well and at a second well from a platform floating upon the surface of a body of water, said method including the steps of;

positioning said floating platform in said body of water at a first vertical position, drilling a first well below said floating platform by use of well operations equipment means lowered downwardly from said floating platform into contact with the bottom of said body of water, thereby initiating well operations at said first well, preparing said first well to produce well fluids to said platform by operatively engaging a first marine riser between said first well and said platform, moving said platform away from above said first well to a second vertical position, movement of said platform laterally displacing and bending a portion of said first marine riser, and drilling a second well below said floating platform, thereby initiating well operations at said second well.

13. A method of simultaneously conducting well operations at a first well and at a second well from a platform floating upon the surface of a body of water, said method including the steps of;

positioning said floating platform in said body of water at a first vertical position, drilling a first well below said floating platform, by use of well operations equipment means lowered downwardly from said floating platform into contact with the bottom of said body of water, thereby initiating well operations at said first well, preparing said first well to produce well fluids to said platform by operatively engaging a first marine riser between said first well and said platform, moving said platform away from above said first well to a second vertical position above said second well, movement of said platform laterally displacing and bending a portion of said first marine riser, and operatively engaging a second marine riser between said floating platform and said second well, thereby initiating well operations at said second well.

* * * * *